US005713268A

United States Patent [19]

Krieger et al.

[11] Patent Number: 5,713,268

[45] Date of Patent: Feb. 3, 1998

[54] WORM EXTRUDER FOR DEWATERING SUSPENSIONS

[75] Inventors: Uwe Krieger; Karl-Heinz Janus, both of Düren, Germany

[73] Assignee: Andreas Kufferath GmbH & Co. KG, Düren, Germany

[21] Appl. No.: 557,068

[22] PCT Filed: Mar. 13, 1995

[86] PCT No.: PCT/EP95/00920

§ 371 Date: Jan. 24, 1996

§ 102(e) Date: Jan. 24, 1996

[87] PCT Pub. No.: WO95/25006

PCT Pub. Date: Sep. 21, 1995

[30] Foreign Application Priority Data

Mar. 14, 1994 [DE] Germany ..... 44 08 539.7

[51] Int. Cl.[6] ..... B30B 9/18

[52] U.S. Cl. ..... 100/45; 100/117; 100/127; 100/148

[58] Field of Search ..... 100/45, 117, 126–129, 100/147, 148

[56] References Cited

U.S. PATENT DOCUMENTS

| | | | |
|---|---|---|---|
| 2,678,600 | 5/1954 | Allen, Jr. | 100/147 |
| 3,276,353 | 10/1966 | Burner et al. | 100/45 |
| 3,394,649 | 7/1968 | Kemper et al. | 100/148 |
| 4,291,619 | 9/1981 | Hunt et al. | 100/117 |

FOREIGN PATENT DOCUMENTS

| | | | |
|---|---|---|---|
| 1368883 | 6/1964 | France . | |
| 2036597 | 12/1970 | France . | |
| 3207878 | 9/1983 | Germany . | |
| 343868 | 7/1992 | U.S.S.R. | 100/148 |
| 1127934 | 9/1968 | United Kingdom . | |
| 1170315 | 11/1969 | United Kingdom . | |
| 1506455 | 4/1978 | United Kingdom . | |

*Primary Examiner*—Stephen F. Gerrity
*Attorney, Agent, or Firm*—Max Fogiel

[57] ABSTRACT

A screw press in which a screw continuously dewaters a suspension. The screw has a threaded section and a downstream compression section with a variable squeeze, and the screw is powered to forward the suspension. A housing accommodates the threaded section and the compression section with the variable squeeze. The suspension is admitted in dilute form at an intake at one end of the press. At another end of the press, the suspension is delivered in dewatered form downstream of the compression section through an outlet. The housing is in the form of a wire basket permeable to liquids and impermeable to solids, and is axially displaceable back and forth adjacent the unthreaded compression section between a non-operating position and an operating position to vary an effective length of the basket. This effective length is zero in the non-operating position for emptying the press. The effective length and the resulting pressure on the compression section corresponds to a desired parameter in the operating position. The compression section, furthermore, is free of separate elements that comprise a squeeze.

24 Claims, 2 Drawing Sheets

WORM EXTRUDER FOR DEWATERING SUSPENSIONS

The present invention concerns a press with a screw for continuously dewatering a suspension. The screw is powered and forwards the suspension. A housing accommodates the threaded section of the screw and a downstream compression section with a variable squeeze. There is in an intake for the dilute suspension at one end of the press and an outlet for the dewatered suspension downstream of the compression section at the other end.

Various types of screw-driven press are known. They can be employed for dewatering various types of suspension (e.g. rejects, slurries, sludges, and pulps). The dilute suspension is poured over the rotating screw through a funnel-shaped intake, and the screw forwards it to the press's outlet. The press accommodates what is called a compression section that also accommodates the squeeze. The screw must accordingly generate enough force in the suspension to overcome the resistance exerted by the squeeze.

The squeeze is embodied in some screw-driven presses by active components, components, that is that can be controlled or regulated. These components constitute mechanically, pneumatically, or hydraulically operated disks, cones, or sheets. The pressure at which they release the suspension is determined by other parameters (type of suspension, final dryness, etc.).

Passive squeeze is also known. It occurs in presses with a housing in the form of a wire basket (Selhe housing) that accommodates a screw followed by a series of compression sections with an unscrew instead of a screw and upstream of the outlet. The compression sections have specific functions.

a) The friction of the stock against the basket and screw increases the pressure (with the screw acting like a brake).

b) Since the suspension remains in the high-pressure section longer, it will be drier as it emerges from the press.

The length of the compression section has an essential influence on the press's operating parameters (power consumption, final dries content, etc.) It can as is known be calculated when the length of the basket is constant from the number of flights on the screw and is established empirically or during start-up. The length of the compression section will accordingly remain invariable in operation. There are considerable drawbacks.

a) The squeeze or pressure loss in the compression section depends on the type of suspension (its friction, shear resistance, etc.) and cannot be varied. As the behavior of the suspension changes, it can lead to operating problems. If pressure losses are too high, power consumption and thrust might increase unacceptably. If friction is too low, the compression section might not be long enough to generate enough pressure. The final dries content might not be high enough. Experience demonstrates that too short a compression section can be compensated for only by an active squeeze mechanism.

b) The compression section might not empty when the machine is turned off. The suspension could cake up, and the stresses (e.g. torque and thrust) might be too high when operations are resumed.

c) Most sludges have to be conditioned (flocculated) before being added to the press. If any gets into the press, even briefly, unflocculated sludge will not be able to force plugs of sludge out of the compression section, and the press will "jam".

d) Thin and relatively dry and water-impermeable deposits can occur directly on the basket in the compression section depending on the dewatering properties and shear resistance of the suspension, and the moister suspension can slide over them. The press's effectiveness can be essentially deteriorated. These deposits can be removed only at considerable expenditure.

SUMMARY OF THE INVENTION

The object of the present invention is accordingly an improved screw-driven press of the aforesaid genus that, without the aforesaid drawbacks, will dewater a suspension efficiently, have a squeeze that can be varied as necessary, and be easy to empty and clean.

The axially displaceable wire basket in-the vicinity of the compression section in accordance with the present invention is a simple means of rapidly adjusting to the prevailing operating conditions the squeeze exerted by the highly efficient compression section and specifically without having to modify the press substantially. These conditions depend on the nature of the suspension and specifically on its frictional behavior and shear resistance. The adjustment can be very rapid. Dewatering will always be ideal and dryness satisfactory, even when the properties of the suspension vary during operation. Operation will be more reliable and there will be no risk of damage to the machinery due to clogging. Since the basket can be entirely displaced, the press will be easy to clean completely, and the basket can be regularly cleared of deposits in the compression section, which is important for removing dried suspension particles and to prevent undo stress on the machinery when it is started again.

The measures that are described concerning displacement of the basket satisfy the conventional practical operating requirements and provide the requisite degrees of squeeze in the compression section.

A further embodiment allows particularly precise continuous adjustment of the length of the compression section to the particular operating conditions. In many applications on the other hand discontinuous displacement will be adequate.

The permissible cross-section of the basket can be left constant while the length of the compression section is varied. The press's overall length can also be left constant, which would be impossible if the whole basket were displaceable.

Preferred characteristics are extremely advantageous. They represent an automatic means of ensuring that the length of the compression section will always be ideally adapted to the particular operating conditions. When output or torque and/or thrust increase too powerfully, it means that the length of the compression section must be decreased (in response to the threat of clogging for example) by displacing the outlet-end section of the basket, to prevent excess thrust. When on the other hand output is too low, it means that the length of the compression section must be increased by displacing the outlet-end section of the basket to ensure satisfactory dewatering. The varying properties of the suspension lead to varying output during operation that can be exploited to vary the length of the compression section over time. The basket or basket section, finally, can be entirely retracted to allow effective emptying or self-cleaning of press.

Measures are provided to ensure a very simple design, wherein a means of adjustment is moved back and forth as the actual adjustment either fails to attain or exceeds an ideal.

An advanced version is preferred when it is necessary to prevent unstable operation. Subsequent to every rapid elongation of the compression section (for the purpose of augmenting the squeeze), there occurs upstream of the threaded second a void that leads to a decrease in output or torque and/or thrust. If the regulator is not inert enough, regulation will be unstable or faulty and the compression section will be temporarily much to long. Regulation can be stabilized by waiting for the reestablishment of equilibrium subsequent to each elongation of the compression section.

A further embodiment includes a mechanism appropriate for adjusting the outlet-end basket section such that the compression section can be automatically adjusted without manual intervention.

Practical embodiments that are described allow reliable, precise, and energy-saving displacement of the outlet-end basket section.

An arrangement is provided to ensure a very simple compression section, with squeeze adjustable strictly by displacing the basket in that vicinity.

Basically, the compression section could be entirely empty. For most suspensions, however, it is of advantage to ensure that it includes an appropriate core. The length of compression section necessary to attain a particular squeeze can also be less.

DESCRIPTION OF THE PREFERRED EMBODIMENTS

Figure 1:
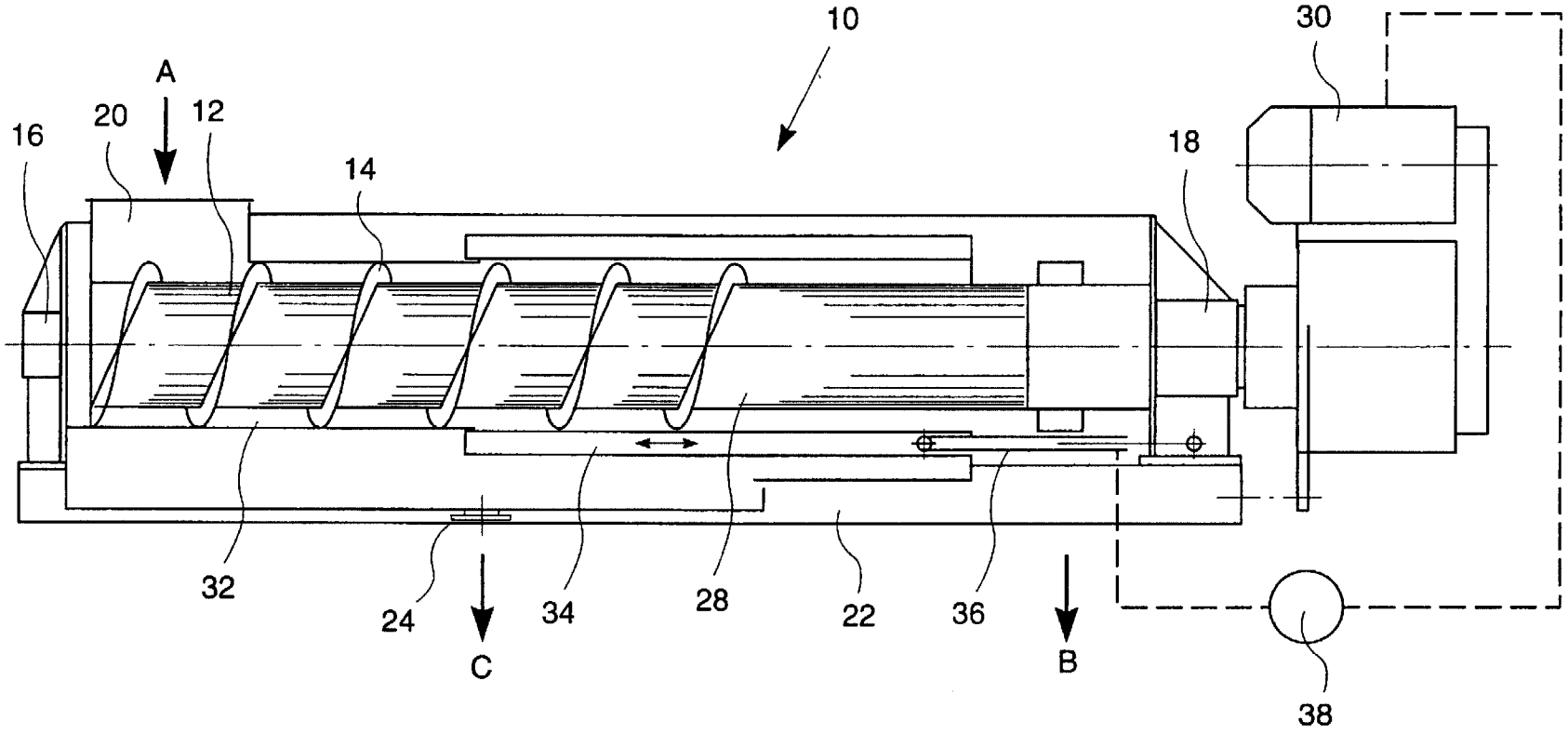
FIG. 1 is a side view and shows the screw together with the cooperating elements, in accordance with the present invention.
Figure 2:
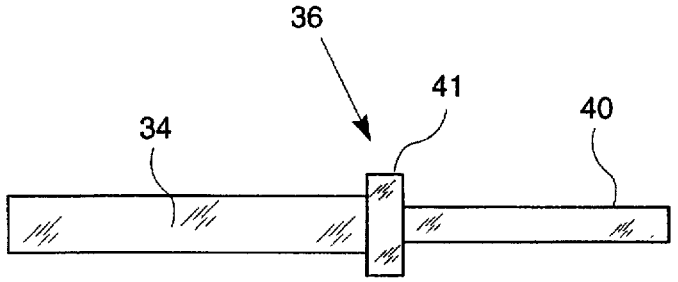
FIG. 2 is a schematic view and shows another embodiment of the mechanism which displaces the basket.
Figure 3:
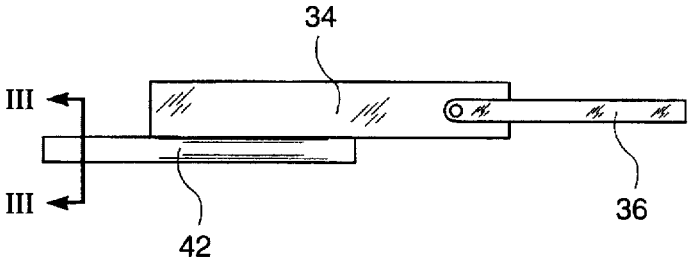
FIG. 3 is a schematic view and shows a further embodiment for displacing the basket.
Figure 4:
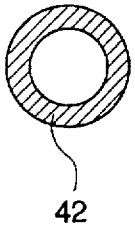
FIG. 4 is a sectional view taken along line III—III in FIG. 3.
Figure 5:
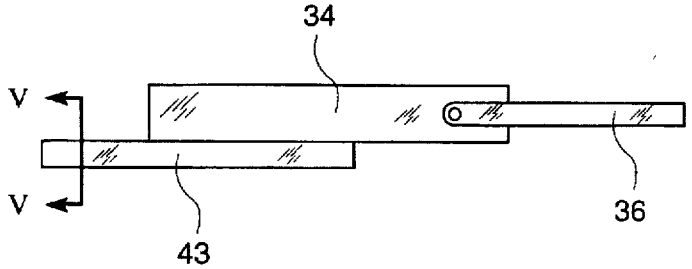
FIG. 5 is a schematic view and shows a still further embodiment for displacing the basket.
Figure 6:
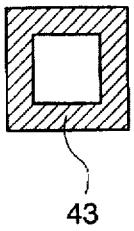
FIG. 6 is a sectional view taken along line V—V in FIG. 5.

A suspension-dewatering press 10 accommodates a screw in the form of a screw 12 with a threaded section 14 on the left, in the vicinity of its intake. Screw 12 rotates in bearings 16 and 18 and is coupled to a motor 30. There is an intake 20 above one end, the left, of screw 12. The dilute suspension enters press 10 through intake 20 in the direction indicated by arrow A. Below the other end of screw 12, which has no thread, is an outlet 22. The dewatered suspension leaves press 10 through outlet 22 in the direction indicated by arrow B. At the very bottom of press 10 is a drain 24. The water forced out of the suspension leaves press 10 through drain 24 in the direction indicated by arrow C.

Screw 12 is concentrically accommodated along with its threaded section 14 in a Selhe housing or wire basket, leaving an annular channel for the suspension. The basket retains the suspension's solid particles and allows the water through. It consists in the present event of two sections, an intake-end basket section 32 and a concentric outlet-end basket section 34. Section 32 is stationary and section 34 slides back and forth over it. Outlet-end basket section 34 accommodates more or less loosely an unthreaded section 28 of screw 12 that compresses the dewatered suspension. The squeeze exerted by section 28 increases the farther outlet-end basket section 34 is displaced to the right.

Outlet-end basket section 34 is provided with an axial-displacement mechanism 36, a hydraulic piston-and-cylinder mechanism in the present case. Axial-displacement mechanism 36 is coupled to motor 30 by way of a regulator stage 38. Regulator stage 38 is part of a set of electronic controls. The signal supplied to these controls is instantaneous motor output, or thrust exerted on the screw or thrust exerted on the basket. When motor output increases above or decreases below a specified threshold outlet-end basket section 34 is displaced left or right to reduce or augment the squeeze exerted by compression section 28 in order to maintain uniform dewatering and protect the machinery.

The basket is axially displaceable back and forth adjacent the unthreaded compression section between a non-operating position and an operating position to vary an effective length of the basket and in which a distance between the non-operating position and the operating position farthest therefrom adjacent the compression section is at least 0.5 to 1.0 times an outside diameter of the threaded section, or in which a distance between the non-operating position and the operating position farthest therefrom adjacent the compression section is at least 2.0 times an outside diameter of the threaded section, or in which a distance between the non-operating position and the operating position farthest therefrom adjacent the compression section is at least 3.0 times an outside diameter of the threaded section.

Regulator stage 38 and mechanism 36 can displace outlet-end basket section 34 all the way to the intake end to facilitate complete emptying of the press. Regulator stage 38 can also ensure that this "zero" position can be attained even while the press is in operation for purposes of self cleaning and hence to prevent clogging. In another embodiment, the mechanism 36 which displaces axially the basket or basket section 34, is in the form of at least one spindle 40 and nut 41, in which one end is fixed and another end can move and is attached to the basket or basket section.

The basket section 34 may also be displaced along cylindrical rods 42.

At the same time, the basket or basket section 34 may be displaced along prismatic rods 43.

We claim:

1. A press comprising: a screw for continuously dewatering a suspension; means for powering said screw to forward the suspension, said screw having a threaded section and a downstream unthreaded compression section with a variable squeeze; a housing accommodating said threaded section and said compression section with said variable squeeze; an intake at one end of the press for admitting the suspension in dilute form; an outlet at another end of the press for delivering the suspension in dewatered form downstream of said compression section; said housing comprising a wire basket permeable to liquids and impermeable to solids, said basket being axially displaceable back and forth adjacent said unthreaded compression section between a non-operating position and an operating position to vary an effective length of said basket, said effective length being zero in said non-operating position for emptying the press, said effective length and a resulting pressure on said compression section corresponding to a desired parameter in said operating position; said compression section being free of separate means comprising a squeeze.

2. A press as defined in claim 1, wherein a distance between said non-operating position and said operating position farthest therefrom adjacent said compression section is at least 0.5 to 1.0 times an outside diameter of said threaded section.

3. A press as defined in claim 2, wherein a distance between said non-operating position and said operating position farthest therefrom adjacent said compression section is at least 2.0 times an outside diameter of said threaded section.

4. A press as defined in claim 2, wherein a distance between said non-operating position and said operating position farthest therefrom adjacent said compression section is at least 3.0 times an outside diameter of said threaded section.

5. A press as defined in claim 1, wherein said basket is displaceable continuously adjacent said compression section.

6. A press as defined in claim 1, wherein said basket is displaceable discontinuously adjacent said compression section.

7. A press as defined in claim 1, wherein said basket has first and second separate vertical sections; said first section being at said intake of the press and being stationary, said second section being at said outlet of the press and being axially displaceable.

8. A press as defined in claim 7, wherein said second section of said basket is coaxial with said first section of said basket and is displaceable over said first section of said basket.

9. A press as defined in claim 1, including adjustment means with a regulator circuit on said basket adjacent said compression section for regulating the position of said basket when the press is in operation in accordance with a desired ideal parameter and an actual parameter, said regulator circuit displacing the basket into said non-operating position for servicing the press.

10. A press as defined in claim 9, including a motor having an output for driving said screw and comprising said actual parameter.

11. A press as defined in claim 9, wherein said actual parameter is produced by a thrust exerted on said screw.

12. A press as defined in claim 9, wherein said actual parameter is produced by a thrust exerted on said basket.

13. A press as defined in claim 9, wherein said regulator circuit is a switching regulator.

14. A press as defined in claim 9, wherein operation of the press is discontinued and said basket is temporarily displaced into said non-operating position by said regulator circuit to allow for self cleaning of the press.

15. A press as defined in claim 14, wherein said basket is temporarily displaced into said non-operating position by said regulator circuit at regular intervals.

16. A press as defined in claim 14, wherein said basket is temporarily displaced into said non-operating position by said regulator circuit in accordance with a specific output.

17. A press as defined in claim 1, including means for axially displacing said basket adjacent said compression section.

18. A press as defined in claim 17, wherein said means for axially displacing said basket comprises at least one piston-and-cylinder unit having a fixed end and a movable end and being attached to said basket.

19. A press as defined in claim 17, wherein said means for axially displacing said basket comprises at least one spindle and nut component having a fixed end and a movable end and being attached to said basket.

20. A press as defined in claim 1, including at least one cylindrical rod along which said basket is displaced.

21. A press as defined in claim 1, including at least one prismatic rod along which said basket is displaced.

22. A press as defined in claim 1, wherein said compression section has an axial core.

23. A press as defined in claim 22, wherein said core is an axial extension of said screw.

24. A press comprising: a screw for continuously dewatering a suspension; means for powering said screw to forward the suspension, said screw having a threaded section and a downstream unthreaded compression section with a variable squeeze; a housing accommodating said threaded section and said compression section with said variable squeeze; an intake at one end of the press for admitting the suspension in dilute form; an outlet at another end of the press for delivering the suspension in dewatered form downstream of said compression section; said housing comprising a wire basket permeable to liquids and impermeable to solids, said basket being axially displaceable back and forth adjacent said unthreaded compression section between a non-operating position and an operating position to vary an effective length of said basket, said effective length being zero in said non-operating position for emptying the press, said effective length and a resulting pressure on said compression section corresponding to a desired parameter in said operating position; adjustment means with a regulator circuit on said basket adjacent said compression section for regulating the position of said basket when the press is in operation in accordance with a desired ideal parameter and an actual parameter, said regulator circuit displacing the basket into said non-operating position for servicing the press; said regulator circuit delaying a next discontinuous change in effective length of said compression section subsequent to one discontinuous change in the effective length by an elongation.

* * * * *